United States Patent [19]

Yamana

[11] Patent Number: 4,583,937

[45] Date of Patent: Apr. 22, 1986

[54] COMBUSTION APPARATUS WITH CONTROL MEANS INCLUDING AN OXYGEN SENSING PROBE AND PROBE THEREFOR

[75] Inventor: Toshifumi Yamana, Kasugai, Japan

[73] Assignee: Rinnai Kabushiki Kaisha, Nagoya, Japan

[21] Appl. No.: 216,521

[22] Filed: Dec. 15, 1980

[30] Foreign Application Priority Data

Dec. 18, 1979 [JP] Japan ..... 54-163571

[51] Int. Cl.[4] ..... F23N 5/00; G01N 27/04; G01N 27/58

[52] U.S. Cl. ..... 431/76; 204/421; 338/34; 422/94; 422/98

[58] Field of Search ..... 204/195 S, 1 S; 431/76; 73/23; 338/34; 422/94, 98

[56] References Cited

U.S. PATENT DOCUMENTS

| | | | |
|---|---|---|---|
| 3,620,931 | 11/1971 | Reichner | 204/1 T |
| 4,151,503 | 4/1979 | Cermak et al. | 204/195 S X |
| 4,193,965 | 3/1980 | Cullingford et al. | 204/195 S X |
| 4,238,185 | 12/1980 | Watson | 431/76 |
| 4,264,425 | 4/1981 | Kimura et al. | 204/195 S |

FOREIGN PATENT DOCUMENTS

| | | | |
|---|---|---|---|
| 1212453 | 10/1959 | France | 431/76 |

*Primary Examiner*—G. L. Kaplan

*Attorney, Agent, or Firm*—Armstrong, Nikaido, Marmelstein & Kubovcik

[57] ABSTRACT

An oxygen sensing probe includes a substrate of sintered zirconia or titania, which is formed with a pair of elongate sensing elements integral with a bridging portion of the substrate, the sensing elements having rare-earth metal electrodes on opposite parallel faces thereof which terminate on the bridging portion, at which point they are connected to electrical leads.

11 Claims, 8 Drawing Figures

COMBUSTION APPARATUS WITH CONTROL MEANS INCLUDING AN OXYGEN SENSING PROBE AND PROBE THEREFOR

FIELD OF THE INVENTION

This invention relates to an oxygen sensing probe, which finds particular application in monitoring the presence of oxygen in a combustion apparatus, in order that an indication may be obtained of the quantity of residual oxygen present in the products of combustion, and in order to determine the sufficiency or deficiency of the quantity of combustion air supplied to the apparatus to support complete combustion of the gaseous fuel supplied thereto.

BACKGROUND OF THE INVENTION

It is prior known in combustion apparatus employing admixed a gaseous fuel and primary combustion air to employ one or more sensing elements for either indicating the presence of excess oxygen in the burner flame, such as will ensure complete combustion of the gaseous fuel with maximum efficiency, or, for indicating the presence of an oxygen deficiency in the products of combustion, such as would result in incomplete and inefficient combustion of the gaseous fuel.

Such sensing elements commonly employ a substrate of a material, such as zirconia, having electrodes of a rare earth metal, such as platinum, on opposite faces thereof, such an element having the capability of developing an electro-motive force across the electrodes in the presence of oxygen by ion exchange at such time as the substrate is heated to a temperature sufficient to reduce the internal electrical resistance of the substrate. Alternatively, the substrate may be formed from titanium, which, upon heating of the substrate to a determined temperature, changes in electrical resistance in direct relationship to the concentration of oxygen present in the combustion products.

The change in electro-motive force in the former type of element, and the change in internal resistance in the latter type of element is employed to control electronic circuitry, which may be employed to effect automatic control of the fuel to air ratio, or, in extreme circumstances, to shut down operation of the combustion apparatus in the event that a potentially dangerous condition exists.

While such an apparatus employing a single element finds application in those circumstances where the gaseous fuel supplied to the combustion apparatus is unchanging in combustion characteristics, problems arise when a gaseous fuel is substituted for an existing fuel supply, in which the substituted fuel has combustion characteristics different from that of the said existing fuel supply.

In order to accomodate change-over in the supply of one gaseous fuel to another, it has been prior proposed to employ two identical sensing elements which are usable either singly or in tandem to control the electronic control circuitry, and which are selectively switchable into the electronic control circuitry in dependence on the combustion characteristics of the fuel supply employed at a particular time.

The provision of dual independent sensing elements, while satisfactory in many respects, is encumbered with the problem of additional expense in the provision of such dual elements, and also is encumbered with the problem of accurately positioning the respective elements relative to the burner in closely adjacent position in order to minimize inaccuracies in detection by the respective elements.

SUMMARY OF THE INVENTION

According to the present invention, the known and dual independent sensing elements are combined into a unitary probe having the dual sensing elements positioned in parallel closely spaced relationship, and the respective elements are interconnected at one of their ends by a bridging portion of the substrate which is common to both of the elements. In use, the bridging portion of the substrate is positioned exteriorly of the combustion apparatus or is otherwise shielded from the combustion products, and is at a temperature insufficient for it to become electrically conductive, thus eliminating the possibility of electrical conduction between the respective elements, and the "short-circuiting" thereof. Preferably, the respective electrodes extend onto and terminate on the bridging portion of the substrate, thus providing for their ready connection to the electronic circuitry in an environment removed from the products of combustion, and which is at a temperature considerably lower than that of the active portions of the sensing elements.

DESCRIPTION OF THE DRAWINGS

The invention will now be described with reference to the accompanying drawings, in which.

Referring to FIGS. 1 to 3 of the drawings, there is shown a plate type burner 1, having a combustion surface 1*a*. Supported from the burner by means of a bracket 1*b* is an oxygen sensing probe 2 of the present invention.

Figure 3:
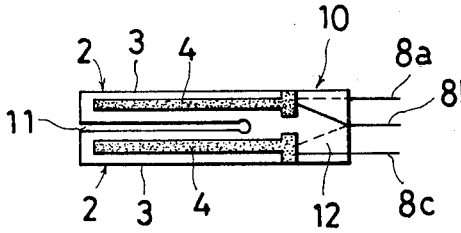
FIG. 3 is an enlarged view of the oxygen sensing probe shown in FIG. 1.

The oxygen sensing probe 2 includes a substrate 10 comprised by a body of a thermally activated electrical conducting material, such as a body of sintered zirconia, which, when heated to a determined range of temperatures, exhibits an electrical conductance in direct relationship with the concentration of oxygen present in a surrounding atmosphere. Sintered zirconia, in the presence of an oxygen containing atmosphere, and when heated to a determined temperature range, exhibits the capability of generating an electromotive force across opposed faces thereof proportional to the concentration of oxygen in the surrounding atmosphere.

Alternatively, sintered titania may be used as the material for the substrate, sintered titania exhibiting the capability of changing in electrical resistance when heated to a determined temperature range in dependence on the quantity of oxygen contained in the surrounding atmosphere, the change in electrical resistance being proportional to the quantity of oxygen contained within the surrounding atmosphere.

The substrate 10 is in the form of an elongate plate which is slit longitudinally at 11 to provide a pair of elongate portions 3 which extend in closely spaced relationship, and which are interconnected at one of their ends by an integral bridging portion 12 of the substrate, each of the elongate portions having opposed substantially parallel faces. Preferably, the slit 11 terminates in a circular aperture in the substrate in order to relieve stresses at that position, and additionally, as will later be described, in order to provide a convenient manner of supporting the substrate relatively to the burner plate.

Extending longitudinally of each of the opposed faces of the elongate portions 3 is an electrode 4 comprised of platinum, the respective electrodes 4 terminating at one of their ends on the bridging portion 12 of the substrate in a manner permitting the attachment thereto of lead wires 8*a*, 8*b* and 8*c*. The respective lead wires are selectively connectable to a comparator 6, which is employed to operate a safety device 7 in dependence on the concentration of oxygen present in the burner gases under evaluation, a switching device 9 being provided, whereby the respective electrodes may be connected to the comparator either separately or in series flow relationship. In this respect, it will be noted that the lead wire 8*a* is connected to the electrode 4 on the rear face of the upper elongate portion 3, that the lead wire 8*b* is connected to the electrode 4 on the forward face of the upper elongate portion 3 and also to the electrode 4 on the rear face of the lower elongate portion 3, and, that the lead wire 8*c* is connected to the electrode 4 on the front face of the lower elongate portion 3. Thus, by the switching arrangement 9, either the upper electrodes 4 may be connected to the comparator 6, the lower electrodes 4 being inoperative, or, by moving the switch 9 to its alternative position, the upper electrodes 4 and the lower electrodes 4 are connected in series flow relationship with the comparator 6. By this arrangement, one of the portions of the sensing probe can be employed alone, or, when the circumstances require, and as is discussed below, both of the electrode portions can be employed in tandem.

As is illustrated in the drawings, the sensing probe is positioned in spaced relationship to the operative face of the burner plate 1*a*, such as by the sensing probe being supported on a pin 13 which extends through the aperature at the inner end of the slot 11, the pin 13 being supported on a bracket 1*b* attached to the burner 1, the substrate 10 thus being positioned such that the electrodes 4 are supported in operative position with the electrodes on one face of the substrate facing the burner flame, and with the electrodes 4 on the opposite face on the substrate facing away from the burner flame. The bridging portion 12 is located exteriorly of the burner, in order that the bridging portion 12 shall be at a temperature considerably lower than that of the elongate portions, thus eliminating the possibility of the bridging portion 12 becoming itself electrically conductive, and, providing a short circuit between the respective ends of the electrodes which terminate thereon.

Figure 4:
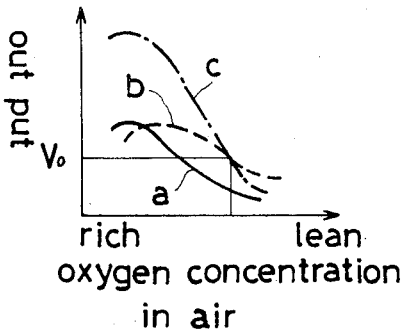
FIG. 4 is a diagram illustrating the output characteristics of the probe of the present invention.

Referring now more particularly to FIG. 4, there is illustrated diagrammatically the output characteristics of the probe of the present invention when operating with gaseous fuels of differing characteristics.

In FIG. 4, the full line a is illustrative of the combustion characteristics of a high-lift property gas of the type 13A. Such a gas has a high sensitivity to inadequacy of the oxygen in the combustion air supply, such that the output of each electrode is lowered at a comparatively high oxygen concentration in the combustion air. If, however, the supply of fuel is changed to one having a low lift property, such as a gas of the type 6C, such a gas has a lower sensitivity to the inadequacy of oxygen in the combustion air to provide for complete combustion, such as is illustrated by the dotted line b in FIG. 4.

An example of a high-lift property gas is liquid natural gas, such a gas having a low combustion speed, and thus, being much more liable for the combustion face to lift-up from the burner, due to the fact that the speed of projection of the gas from the burner becomes higher than the combustion speed of the gas.

A typical gas of low-lift property, which also is referred to as a back-property gas, is coal gas. In a gas of this type, the combustion speed is extremely high, and thus resists lifting of the flame front from the burner face. Under adverse conditions, the flame speed may exceed the speed of projection of the gas from the burner face, thus causing back firing of the flame front into the burner.

Liquid natural gas falls within the classification 13A, while coal gas falls into the classification 6C, these classifications indicating the combustion potential of the respective gases and the Wobbe index thereof.

Figure 1:
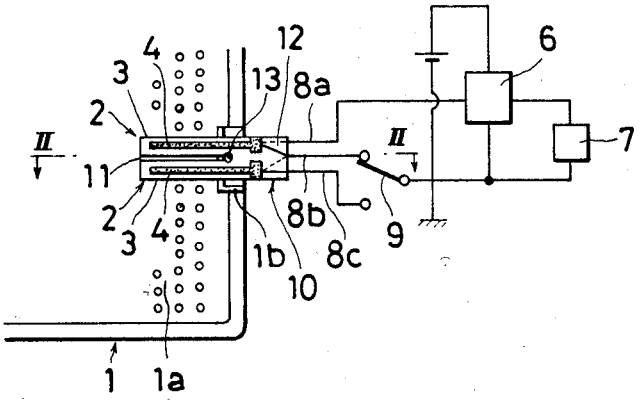
FIG. 1 is an illustration of the oxygen sensing probe of the present invention in the environment of a combustion apparatus, the associated electronic circuitry being schematically illustrated.

In order to provide for the interchange of different gaseous fuels, at the time a gaseous fuel of the type 6C is employed, the switch 9 is moved to its position as shown in FIG. 1, thus inserting a single set of electrodes into the electronic circuitry, and, permitting the sensing probe to operate over the optimum range required by that particular gaseous fuel. However, it will be noted that at the time optimum oxygen concentration is indicated for a gas of a low lift property such as a gas of the type 6C, a change over to a gas of high-lift property such as a gas of the type 13C will produce an output from that single electrode which is less than that required for satisfactory operation of the comparator 6. To overcome this problem, the switch 9 is moved from its position shown in FIG. 1 to its alternative position, thus connecting both sets of electrodes in series, and, doubling the output of the sensing probe as indicated by the chain dotted line c in FIG. 4. In this manner, satisfactory operation of the probe is obtained when using gases of either a low lift property or a high-lift property, i.e., gases of the type 6C and 13A can be accommodated merely by switching from single electrode operation to series operation of the dual electrodes.

Figure 2:
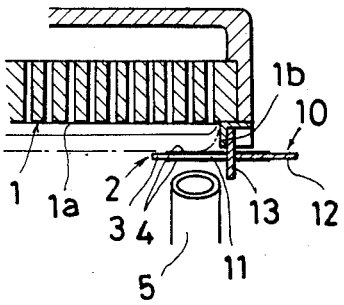
FIG. 2 is a cross-section taken on the line II—II of FIG. 1.

The electrodes 4 on the front surface of the sensing probe at all times are contacted by a reference flow of combustion gases from a standing pilot burner 5. Thus, at the time combustion of the burner is resulting in complete combustion of the fuel gas, there is generated an output across the respective pairs of electrodes corresponding to a difference in the oxygen concentration between the front and rear electrodes of each pair. If, for any reason, an incomplete combustion condition arises, then the combustion gas flow will change from its position shown in full lines in FIG. 2 to the incomplete combustion condition shown in dotted lines in that figure. As a consequence the electrodes 4 on the rear face of the sensing probe are brought into contact with the incompletely combusted gas, and, consequently, the difference in oxygen concentration between the electrodes 4 on the front and rear surfaces of the sensing probe is sensed, this resulting in a decrease in the output of the sensing probe.

Figure 5:
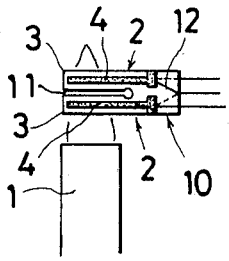
FIGS. 5 and 6 are respectively front and side views of the probe of the present invention in association with a pilot light of a combustion apparatus.
Figure 6:
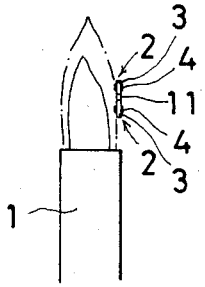
Figure 7:
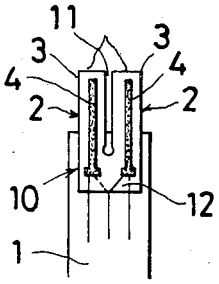
FIGS. 7 and 8 are respectively front and side views of the probe of the present invention in an alternative orientation relatively to the pilot light of FIGS. 5 and 6.
Figure 8:
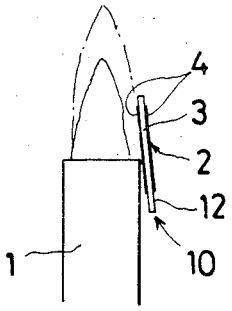

FIGS. 5 through 8 illustrate the employment of the oxygen sensing probe of the present invention in conjunction with a pilot burner, the sensing probe either being employed in a horizontal attitude as illustrated in FIGS. 5 and 6, or, in a vertical attitude as illustrated in FIGS. 7 and 8. By employing the probe of the present invention in the environment of a pilot burner, an indication can be obtained with respect to the correct operation of the burner, and, the sensing probe can be employed in a defeat circuit to close down the furnace in the event that improper operation of the pilot burner is sensed, or, in the event that the pilot burner should become extinguished for any reason.

By forming the electrodes on a substrate which is common to both sets of electrodes, extremely accurate positioning of the respective electrodes can be obtained without any difficulty, thus eliminating the possibility of spurious outputs from the respective electrodes resulting from the incorrect positioning thereof relatively to the burner flame. Further, by virtue of the closely spaced positioning of the respective pairs of electrodes, substantial differences in reading are eliminated, thus resulting in the greater accuracy of the output obtained from the respective electrodes when operating either singly or in tandem.

What we claim is:

1. An oxygen sensing probe, including: a substrate of a thermally activated, electrical conducting material which, when within a determined range of temperatures, exhibits an electrical conductance in direct relationship with the concentration of oxygen present in a surrounding atmosphere;

elongate portions of said substrate extending in closely spaced relationship and which are interconnected at one of their ends by an integral bridging portion of the substrate, each said elongate portion having opposed substantially parallel faces; and an electrode of platinum extending lonqitudinally of each of said opposed substantially parallel faces of each elongate portion and in contact therewith, and which terminates at one of its ends on said bridging portion.

2. The oxygen sensing probe of claim 1, in which said substrate is a sintered body of an oxygen ion conductive solid electrolyte.

3. The oxygen sensing probe of claim 2, in which said substrate is zirconia.

4. The oxygen sensing probe of claim 1, in which said substrate is titania.

5. The oxygen sensing probe of claim 1, in which said elongate portions and said bridging portion are coplanar.

6. The oxygen sensing probe of claim 1, in which the substrate is a flat sheet having opposed parallel faces, and in which said opposed substantially parallel faces on said elongate portions are coplanar with the respective opposed parallel faces of the substrate.

7. In a combustion apparatus of the type including dual electrically conductive oxygen sensing elements and an electronic circuit selectively connected to said sensing elements and which controls the ratio of air to fuel supplied to said apparatus, the improvement comprising;

a unitary sensing probe constituted by a substrate of a thermally-activated, electrically conducting material which, when within a determined range of temperatures, exhibits an electrical conductance in direct relationship with the concentration of oxygen present in a surrounding atmosphere;

elongate portions of said substrate extending in closely spaced relationship and which are interconnected at one of their ends by an integral bridging portion of the substrate, each said elongate portion having opposed substantially parallel faces;

an electrode of platimun extending longitudinally of each said face and in contact therewith, and which terminates at one of its ends on said bridging portion; and, an electrical connection between each said electrode and said electronic circuit;

said sensing probe being positioned in the combustion apparatus with said elongate portions exposed to the products of combustion and said bridging portion shielded from said products of combustion.

8. The combination of claim 7, further including a change-over switch incorporated into said electronic circuit for selectively connecting the electrodes of a single one of said elongate portions to said circuit, or, for selectively connecting the electrodes of a plurality of said elongate portions to said circuit in series connected relationship.

9. The combination of claim 7, in which said bridging portion of the substrate is positioned exteriorly of the combustion apparatus, and said elongate portions extend into said combustion apparatus, into a position in which they are exposed to the combustion products, said bridging portion being isolated from said combustion products.

10. The combination of claim 7, in which the burner of said combustion apparatus is a plate type burner, and said sensing probe is located adjacent to the burner face thereof.

11. The combination of claim 7, in which said sensing probe is located adjacent a pilot burner of said combustion apparatus.

* * * * *